US011436903B2

(12) United States Patent
NG et al.

(10) Patent No.: US 11,436,903 B2
(45) Date of Patent: Sep. 6, 2022

(54) SYSTEM AND METHOD FOR TRACKING INTRUDERS

(71) Applicant: Michael NG, Taipei (TW)

(72) Inventors: Caitlyn Morgan NG, Santa Monica, CA (US); Michael NG, Taipei (TW)

(73) Assignee: Michael Ng, Taipei (TW)

( * ) Notice: Subject to any disclaimer, the term of this patent is extended or adjusted under 35 U.S.C. 154(b) by 39 days.

(21) Appl. No.: 17/105,647

(22) Filed: Nov. 27, 2020

(65) Prior Publication Data

US 2021/0174651 A1 Jun. 10, 2021

Related U.S. Application Data

(60) Provisional application No. 62/943,818, filed on Dec. 5, 2019.

(51) Int. Cl.
*G08B 15/02* (2006.01)
*G08B 13/16* (2006.01)
*G08B 13/196* (2006.01)

(52) U.S. Cl.
CPC ... *G08B 13/1672* (2013.01); *G08B 13/19697* (2013.01); *G08B 15/02* (2013.01)

(58) Field of Classification Search
CPC ..... G08B 13/1672; G08B 13/19697; G08B 15/02
See application file for complete search history.

(56) References Cited

U.S. PATENT DOCUMENTS 10,325,465 B2 * 6/2019 Svoboda ..... G08B 7/06
2009/0122144 A1 * 5/2009 Latham ..... G08B 13/19697 348/155
2010/0128123 A1 * 5/2010 DiPoala ..... G08B 13/19619 340/541
2015/0061869 A1 * 3/2015 Crowe ..... G08B 15/02 340/541
2015/0124087 A1 * 5/2015 Jones, Jr. ..... G08B 15/02 348/143
2016/0042625 A1 * 2/2016 Mattern ..... G08B 21/02 340/907
2020/0074825 A1 * 3/2020 Martin ..... G08B 13/19632
2020/0143649 A1 * 5/2020 Coonley ..... G08B 17/08

* cited by examiner

*Primary Examiner* — Andrew W Bee

(57) ABSTRACT

Disclosed herein is a security system for locating and tracking an intruder. The present security system comprises a plurality of security master devices, and a control device linked to the plurality of security master devices. According to embodiments of the present disclosure, each security master device comprise a microphone, a tracking unit, optionally a deterrent unit, optionally an image capturing unit. The control device comprises a processor, and optionally a memory. Also disclosed herein is a method for locating and tracking an intruder.

16 Claims, 5 Drawing Sheets

SYSTEM AND METHOD FOR TRACKING INTRUDERS

CROSS-REFERENCE TO RELATED APPLICATIONS

This application relates to and claims the benefit of U.S. Provisional Application No. 62/943,818, filed Dec. 5, 2019; the content of the application is incorporated herein by reference in its entirety.

BACKGROUND OF THE INVENTION

1. Field of the Invention

The present disclosure in general relates to a security system. More particularly, the present disclosure relates to a security system for locating and tracking intruders by detecting acoustic events from the intruders.

2. Description of Related Art

Violence and criminal activity involving firearms have become a significant problem worldwide. It is reported that the total firearm death rate increased 17 percent over the past decade, in which Brazil has the largest firearm death toll with over forty thousand people killed per year, followed by the United States, India, Mexico, Colombia, Venezuela, Philippines, and Guatemala. In addition, shooting on college campuses also continues to rise that has increased concern among students, parents and teaches.

A variety of surveillance systems have been developed to recognize and monitor gunshot events that may deliver a real-time information regarding the criminal activities to law enforcement authorities. However, even the surveillance system is triggered, there is still sufficient time for the perpetrator to carry out the massacre and escape in the chaos, before the law enforcement officers arrive. In view of the foregoing, there exists in the related art a need for a novel security system for promptly tracking and/or deterring the perpetrator so that the damage caused by the perpetrator could be reduced to a minimum.

SUMMARY

The following presents a simplified summary of the disclosure in order to provide a basic understanding to the reader. This summary is not an extensive overview of the disclosure and it does not identify key/critical elements of the present invention or delineate the scope of the present invention. Its sole purpose is to present some concepts disclosed herein in a simplified form as a prelude to the more detailed description that is presented later.

As embodied and broadly described herein, one aspect of the disclosure is directed to a security system for locating and tracking an intruder by detecting an acoustic event from the intruder. The security system comprises a plurality of security master devices, and a control device linked to the plurality of security master devices.

According to embodiments of the present disclosure, each of the plurality of security master devices comprises a microphone configured to detect the acoustic event, and a tracking unit configured to dispense a tracking substance. Regarding the control device, it comprises a processor, which is configured to determine a location of the intruder based on the detected acoustic event, and then control at least one tracking unit to dispense the tracking substance based on the location of the intruder so as to track the intruder.

According to some embodiments of the present disclosure, the acoustic event is a gunshot, or an explosion.

According to certain preferred embodiments, the microphone is a directional microphone.

The tracking substance dispensed by the tracking unit may be a dye, a pigment, a fluorescent molecule, a luminescent molecule, a contrasting agent, or a combination thereof.

Optionally, each of the plurality of security master devices further comprises a deterrent unit that is controlled by the processor and configured to dispense a deterrent substance thereby deterring the movement of the intruder. Depending on desired purposes, the deterrent substance may be a net, a tear gas, a pepper spray, a rubber bullet, or a combination thereof.

Optionally, each of the plurality of security master devices further comprises an image capturing unit that is configured to capture an image of the intruder and transmits the image to the processor.

According to certain embodiments of the present disclosure, the control device further comprises a memory that is linked to the processor and configured to store the acoustic event and/or the image.

Still optionally, the present security system may further comprise an alert device linked to the control device.

According to some embodiments, each security master device of the present security system is spaced at least 5 meters from its adjacent security master device. In certain working examples, each security master device is spaced about 5-10 meters from its adjacent security master device.

According to certain embodiments, the processor of the control device is further configured to direct the security master devices toward the location of the intruder based on the detected acoustic event.

Another aspect of the present disclosure pertains to a method of locating and tracking an intruder via detecting an acoustic event (e.g., a gunshot, or an explosion) from the intruder. The method comprises the steps of, (1) detecting the acoustic event; (2) determining a location of the intruder based on the detected acoustic event; and (3) dispensing a tracking substance from one or more tracking units based on the determined location of the intruder so as to track the intruder.

According to certain embodiments of the present disclosure, the acoustic event is independently detected by one or more microphones, wherein the microphone may be a directional microphone.

The tracking substance may be a dye, a pigment, a fluorescent molecule, a luminescent molecule, a contrasting agent, or a combination thereof.

Optionally, the method further comprises the step of, dispensing a deterrent substance from one or more deterrent units so as to deter the movement of the intruder. Non-limiting examples of the deterrent substance include, a net, a tear gas, a pepper spray, a rubber bullet, or a combination thereof.

Optionally, the method further comprises the step of, capturing an image of the intruder by an image capturing unit.

Still optionally, the method further comprises the step of, storing the acoustic event and/or the image onto a memory.

Additionally, the method may further comprise the step of, directing the tracking units toward the location of the intruder based on the detected acoustic event.

Many of the attendant features and advantages of the present disclosure will becomes better understood with reference to the following detailed description considered in connection with the accompanying drawings.

BRIEF DESCRIPTION OF THE DRAWINGS

The present description will be better understood from the following detailed description read in light of the accompanying drawings, where.

Figure 1A:
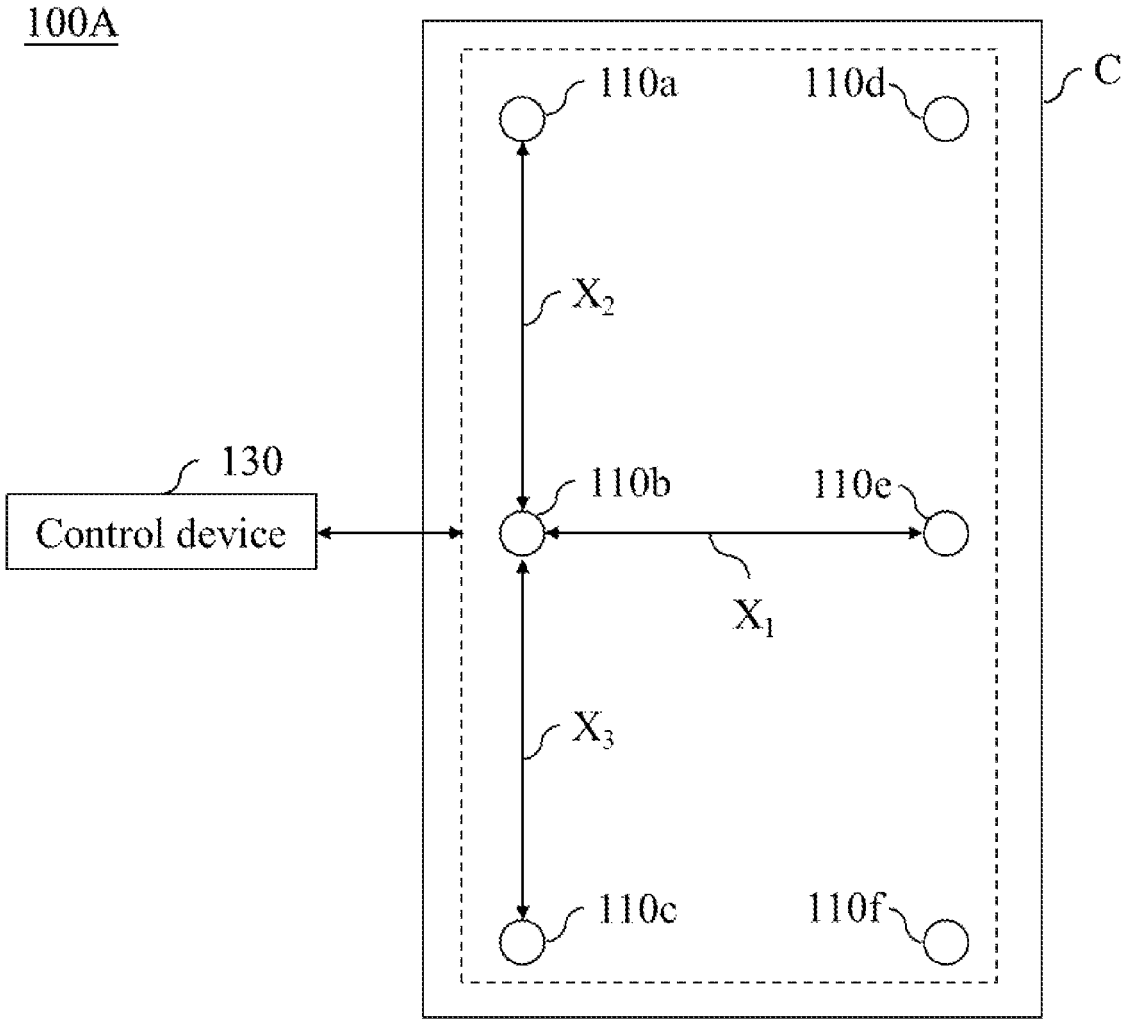
FIGS. 1A and 1B are schematic diagrams respectively depicting the configurations of security system 100A and 100B in a corridor (C) or a room (R) according to one embodiment of the present disclosure.

In accordance with common practice, the various described features/elements are not drawn to scale but instead are drawn to best illustrate specific features/elements relevant to the present invention. Also, like reference numerals and designations in the various drawings are used to indicate like elements/parts.

DETAILED DESCRIPTION OF THE INVENTION

The detailed description provided below in connection with the appended drawings is intended as a description of the present examples and is not intended to represent the only forms in which the present example may be constructed or utilized. The description sets forth the functions of the example and the sequence of steps for constructing and operating the example. However, the same or equivalent functions and sequences may be accomplished by different examples.

I. Definition

For convenience, certain terms employed in the specification, examples and appended claims are collected here. Unless otherwise defined herein, scientific and technical terminologies employed in the present disclosure shall have the meanings that are commonly understood and used by one of ordinary skill in the art. Also, unless otherwise required by context, it will be understood that singular terms shall include plural forms of the same and plural terms shall include the singular. Specifically, as used herein and in the claims, the singular forms "a" and "an" include the plural reference unless the context clearly indicates otherwise. Also, as used herein and in the claims, the terms "at least one" and "one or more" have the same meaning and include one, two, three, or more.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in the respective testing measurements. Also, as used herein, the term "about" generally means within 10%, 5%, 1%, or 0.5% of a given value or range. Alternatively, the term "about" means within an acceptable standard error of the mean when considered by one of ordinary skill in the art. Other than in the operating/working examples, or unless otherwise expressly specified, all of the numerical ranges, amounts, values and percentages such as those for quantities of materials, durations of times, temperatures, operating conditions, ratios of amounts, and the likes thereof disclosed herein should be understood as modified in all instances by the term "about". Accordingly, unless indicated to the contrary, the numerical parameters set forth in the present disclosure and attached claims are approximations that can vary as desired. At the very least, each numerical parameter should at least be construed in light of the number of reported significant digits and by applying ordinary rounding techniques.

The terms "locating" and "location" are interchangeably used in the present disclosure, and refers to the identification or discovery of the place or position of a subject (e.g., an intruder) at a current time (e.g., the time when an acoustic event occurs) and/or some later time. The place or position of the subject may refer to an absolute position (e.g., a geographical position) of the subject, or a relative position of the subject, e.g., the positional relationship between the subject and a defined or reference object (such as, a building, a tree, or a facility).

The term "tracking" as used herein is intended to have a meaning understood by those skilled in the art, and refers to the monitoring of the movement, status, or position (e.g., an absolute or relative position) of a subject (e.g., an intruder). More specifically, the term "tracking" generally refers to the acquisition of the subject's position and orientation relative to a coordinate system or a reference object.

As used herein, the term "acoustic event" refers to sound waves that can be detected by an electronic device, for example, a microphone of the present security system. The acoustic event may refer to a relatively short event that lasts only milliseconds (e.g., a gunshot), or to a relative long event that may last for seconds, or even minutes (e.g., an explosion).

As used herein, the term "directional microphone (DM)" refers to a physical directional microphone that is vented on both sides of the sensing diaphragm. As would be appreciated, the term "directional microphone" as used herein include not only any microphone which is acoustically directional, but also any array of microphones whose signals are processed in either the analog or digital domain to produce a single output signal such that the array behaves like a directional microphone. If all the signals from an array of microphones are recorded in a time-synchronized manner, the recorded signals may be post-processed in different ways after the fact to selectively listen in different directions.

The term "adjacent" or "neighboring" generally relates to and is understood to mean two components (e.g., two security master devices), which are near or close to, but not necessarily touching, each other. Specifically, the term "adjacent" or "neighboring" as used herein refers to two security master devices, which are set immediately next to each other, with no other security master devices disposed between said two security master devices.

II. Description of the Invention

The present disclosure aims at providing a system and a method for locating and tracking an intruder via detecting an acoustic event (e.g., a gunshot, or an explosion) from the intruder. The present system and method are advantageous in capable of promptly responding to an adverse scenario (e.g., gun shooting or explosion caused by an intruder), preferably within milliseconds upon the occurrence of the incident, so that any damage that might have been resulted from the incident may be reduced to a minimum.

According to embodiments of the present disclosure, the present security system comprises a plurality of security master devices; and a control device linked to each of the security master devices. Each security master device is configured to detect an acoustic event, and provide a response to the acoustic event by the control device. In operation, the security system of the present disclosure may be installed inside or around the perimeter of an area intended to be protected, such as a building, a school yard, a shopping center, a classroom, a parking lot, and the like; and preferably, with the plurality of security master devices being arranged in rows along the celling or the wall of a hallway, a corridor, or a room of a building.

Reference is now made to FIG. 1A, which depicts a layout of a security system 100A in a corridor (C) of a building. In this embodiment, the security system 100A is depicted to comprise six security master devices (110*a*, 110*b*, 110*c*, 110*d*, 110*e*, 110*f*) respectively spaced by a distance. The security master devices (110*a*, 110*b*, 110*c*, 110*d*, 110*e*, 110*f*) are arranged in two rows juxtaposed in parallel to each other, in which the first row of the security master devices (110*a* to 110*c*) and the second row of the security master devices (110*d* to 110*f*) are spaced by a distance $X_1$. Further, the security master devices 110*a* and 110*b* (or their parallel security master devices 110*d* and 110*e*) are spaced by a distance $X_2$, and the security master devices 110*b* and 110*c* (or their parallel security master devices 110*e* and 110*f*) are spaced by a distance $X_3$. The distances $X_1$, $X_2$ and $X_3$ may independently vary with practical factors, such as the room of the corridor (C), as well as the total number or arrangement of the security master devices intended to be set up in the corridor (C). As would be appreciated, the distance between any two adjacent security master devices (i.e. the distance $X_1$, $X_2$ or $X_3$) should be a distance sufficient for the location of an acoustic event to be determined via a geometric method (such as, a trilateration or multilateration method). According to some preferred embodiments, each of the distances $X_1$, $X_2$ and $X_3$ is at least 5 meters, for example, 5, 6, 7, 8, 9, or 10 meters. To execute the locating and tracking function, in addition to the security master devices (110*a*, 110*b*, 110*c*, 110*d*, 110*e*, 110*f*), the security system 100A further comprises a control device 130, which is linked to and configured to control each of the security master devices (110*a*, 110*b*, 110*c*, 110*d*, 110*e*, 110*f*).

Figure 1B:
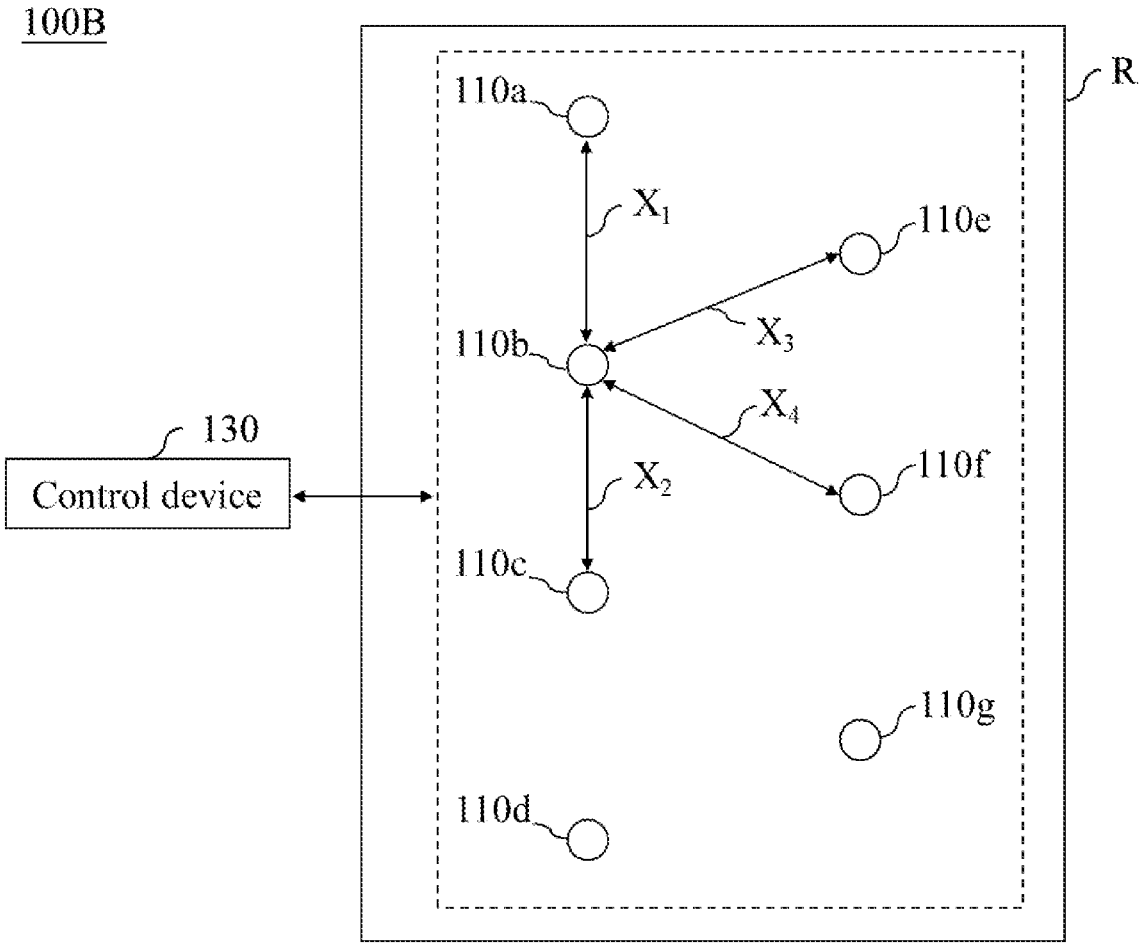

FIG. 1B provides an alternative layout of a security system 100B in a room (R). In this embodiment, the security system 100B is depicted to comprise seven security master devices (110*a*, 110*b*, 110*c*, 110*d*, 110*e*, 110*f*, 110*g*), and a control device 130 linked to each of the security master devices. The configuration of the security system 100B is quite similar to that of the security system 100A, except the first row comprises four security master devices (110*a*, 110*b*, 110*c*, 110*d*), and the second row comprises three security master devices (110*e*, 110*f*, 110*g*). As mentioned above, the distance between any two adjacent security master devices may be altered in accordance with practical conditions, as long as such the distance between any two neighboring security master devices is sufficient for the determination of the location of an acoustic event by a geometric method described above. In this way, the security master device 110*b* may be spaced apart from its neighboring master devices 110*a*, 110*c*, 110*e* and 110*f* by distances $X_1$, $X_2$, $X_3$ and $X_4$, respectively, in which the distances $X_1$, $X_2$, $X_3$ or $X_4$ may be same or different. For example, $X_1$, $X_2$, $X_3$ and $X_4$ may be respectively 5, 6, 7 and 7 meters. Alternatively, $X_1$, $X_2$, $X_3$ and $X_4$ may be respectively 10, 10, 15 and 18 meters for a wide-area surveillance.

As would be appreciated, the total number of the security master devices of the present security system may vary with factors, such as the area of surveillance, and the distance between two adjacent security master devices. Although the number of the security master devices and the distance between two neighboring security master devices do not restrict the present embodiment, however, in one exemplary example, the present security system comprises at least 2 (e.g., 2, 3, 4, 5, 6, 7, 8, 9, 10, 15, 20, 25, 30, 35, 40, 45, 50, 55, 60, 65, 70, 75, 80, 85, 90, 95, 100, 105, 110, 115, 120, 125, 130, 135, 140, 145, 150, 155, 160, 165, 170, 175, 180, 185, 190, 195, 200 or more) security master devices, with each security master device being spaced apart from its adjacent security master device by at least 5 meters. Preferably, two adjacent security master devices are spaced apart from each other by about 5-10 meters (e.g., 5, 6, 7, 8, 9, or 10 meters).

Figure 2:
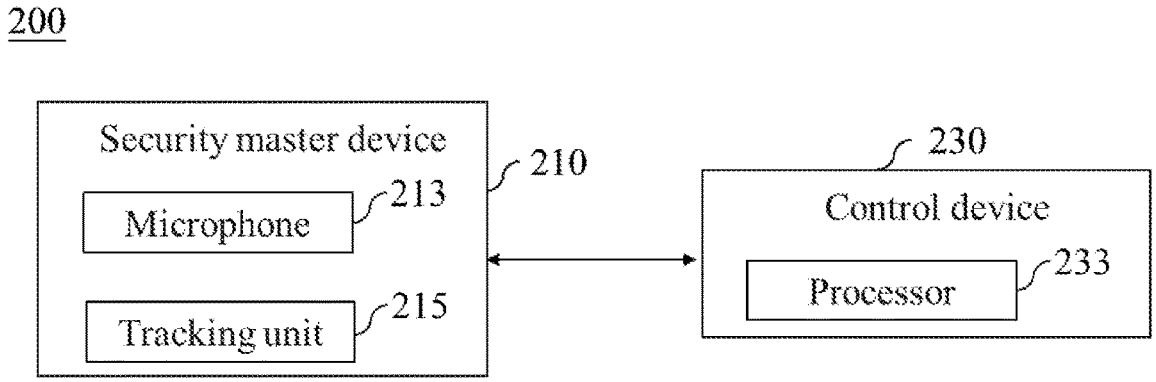
FIG. 2 is a block diagram of a security system 200 according to one embodiment of the present disclosure. The security system 200 comprises a security master devices 210, and a control device 230 linked to the security master device 210.
Figure 3:
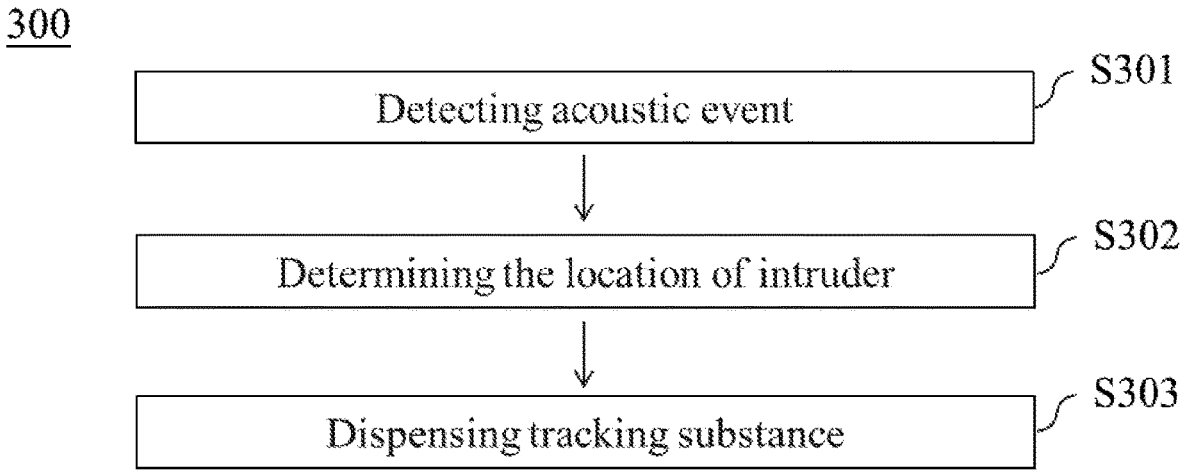
FIG. 3 is a flow diagram illustrating steps for performing a method 300 for locating and tracking an intruder according to one embodiment of the present disclosure.

Reference is now made to both FIGS. 2 and 3, in which FIG. 2 is a block diagram illustrating the configuration of a security system 200 according to one embodiment of the present disclosure, and FIG. 3 is a flow diagram illustrating steps S301-S303 for performing a method 300 for locating and tracking an intruder according to the present embodiment.

The security system 200 comprises a plurality of security master devices 210, and a control device 230 linked to each of the security master devices 210. In structure, each of the security master devices are identical, and hence, only one security master devices 210 is depicted in FIG. 2 for the sake of brevity. The security master device 210 comprises a microphone 213, and a tracking unit 215. The microphone 213 is constructed to identify an abnormal acoustic event, such as a gunshot or an explosion caused by an intruder, a scream in panic, and the like; and the tracking unit 215 is constructed to release a tracking substance for the marking or tracking purpose. The control device 230 comprises a processor 233 configured to command each security master device 210 to perform the method 300 as indicated in the flow diagram of FIG. 3. Specifically, the abnormal acoustic event is detected by at least one of the microphones built in the security master devices 210 (step S301 of the method 300), and at least one corresponding acoustic signal is then generated and transmitted from the at least one microphone to the processor 233, where the acoustic signal(s) is/are used to derive the location the abnormal acoustic event took place. According to some embodiments of the present disclosure, the processor 233 subjects the acoustic signals from 2 neighboring microphones to spatial processing (e.g., Edge computing), so that the exact location of the acoustic event may be derived via trilateration method (i.e., triangle localization; step S302 of the method 300). In the case when the acoustic event is a gunshot, the thus determined location is then outputted from the processor 233 to at least one of the tracking units 215, which proceeds to dispense a tracking substance housed therein (step S303 of the method 300) to mark or track the intruder. The tracking substance may be any substance useful in labeling the intruder and/or impeding the visualization/movement of the intruder; for example, a dye, a pigment, a fluorescent molecule, a luminescent molecule, a contrasting agent, or a combination thereof. According to some embodiments of the present disclosure, the tracking substance is dispensed from one or more tracking units near the location of the intruder so as to create an "effective zone" to ensure the intruder is labeled and/or impeded, and accordingly, the law enforcement officers may efficiently identify and arrest the intruder.

Alternatively, in the case when the acoustic event is not a gunshot or an explosion (e.g., a panic scream), the location of the acoustic event, which is determined by the control device 230 via the manner described above, may be sent to a nearby security person or guard, so that he/she may proceed to further investigate the cause of the acoustic event, and take any necessary action.

According to examples of the present disclosure, each microphones 213 may be a directional microphone, e.g., a dual directional microphone, or an omni-directional microphone. Depending on intended purposes, the microphone 213 may be set to detect the acoustic event continuously or intermittently, for example, by detecting the acoustic event once per second.

Figure 4:
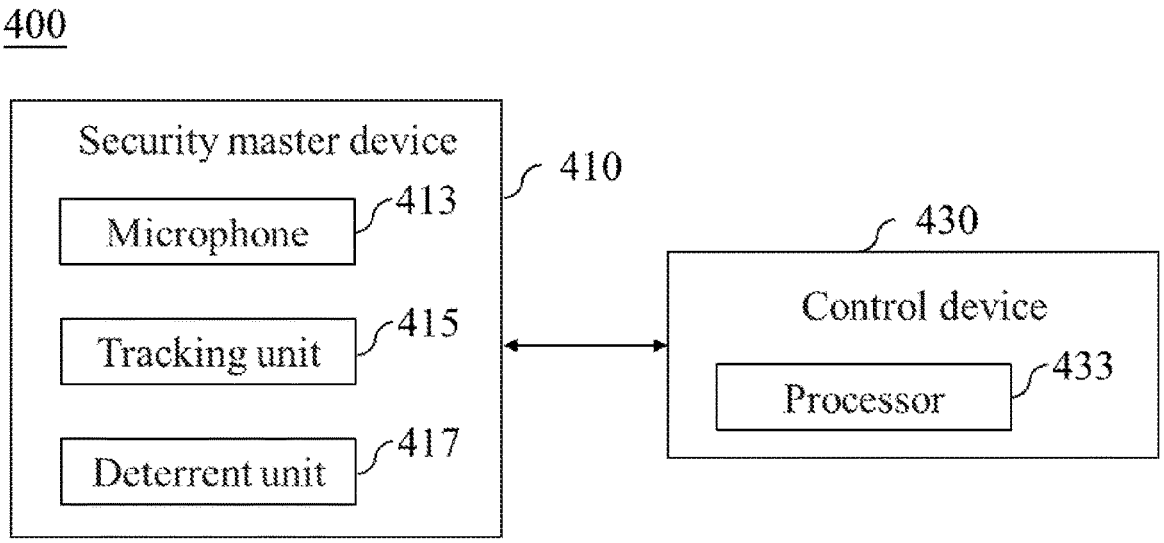
FIG. 4 is block diagram of a security system 400 according to another embodiment of the present disclosure. The security system 400 comprises a security master device 410, and a control device 430, wherein the security master device 410 comprises a microphone 413, a tracking unit 415, and a deterrent unit 417.

FIG. 4 provides an alternative embodiment of the present security system 400. The configuration of the security system 400 is quite similar to that of the security system 200 of FIG. 2, except the security master device 410 further comprises a deterrent unit 417, in addition to the microphone 413 and tracking unit 415. In operation, after receiving the location information from the processor 433 of the control device 430, the deterrent unit 417 dispenses a deterrent substance to the intruder thereby deterring his/her movement. Non-limiting examples of the deterrent substance suitable for using in the present security system include, a net, a tear gas, a pepper spray, a rubber bullet, or a combination thereof.

According to some preferred embodiments of the present disclosure, the directions of the tracking unit 415 and the deterrent unit 417 are independently controlled by the processor 433 based on the acoustic information so that the tracking substance and deterrent substance may be aimed toward the intruder in an optimal direction.

The tracking substance and deterrent substance may be simultaneously or sequentially dispensed toward the intruder. According to one embodiment, after receiving the acoustic information from the processor 433, the tracking substance and deterrent substance are simultaneously dispensed from the tracking unit 415 and the deterrent unit 417. According to another embodiment, the tracking substance is first dispensed from the tracking unit 415 followed by the release of the deterrent substance from the deterrent unit 417. According to still embodiment, the deterrent substance is first dispensed from the deterrent unit 417, and then, the tracking substance is dispensed from the tracking unit 415. In the case when the tracking substance and deterrent substance are dispensed sequentially, the releases of these two substances are separated by an interval of milliseconds to minutes in accordance with desired operation, for example, being separated by an interval of 0.001, 0.002, 0.003, 0.004, 0.005, 0.006, 0.007, 0.008, 0.009, 0.01, 0.02, 0.03, 0.04, 0.05, 0.06, 0.07, 0.08, 0.09, 0.1, 0.2, 0.3, 0.4, 0.5, 0.6, 0.7, 0.8, 0.9, 1, 2, 3, 4, 5, 6, 7, 8, 9, 10, 20, 30, 40, 50, 60, 70, 80, 90, 100, 200, 300, 400, 500, 600, 700, 800 or 900 milliseconds; 1, 2, 3, 4, 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, 40, 41, 42, 43, 44, 45, 46, 47, 48, 49, 50, 51, 52, 53, 54, 55, 56, 57, 58 or 59 seconds; or 1, 2, 3, 4, 5, 6, 7, 8, 9 or 10 minutes.

Figure 5:
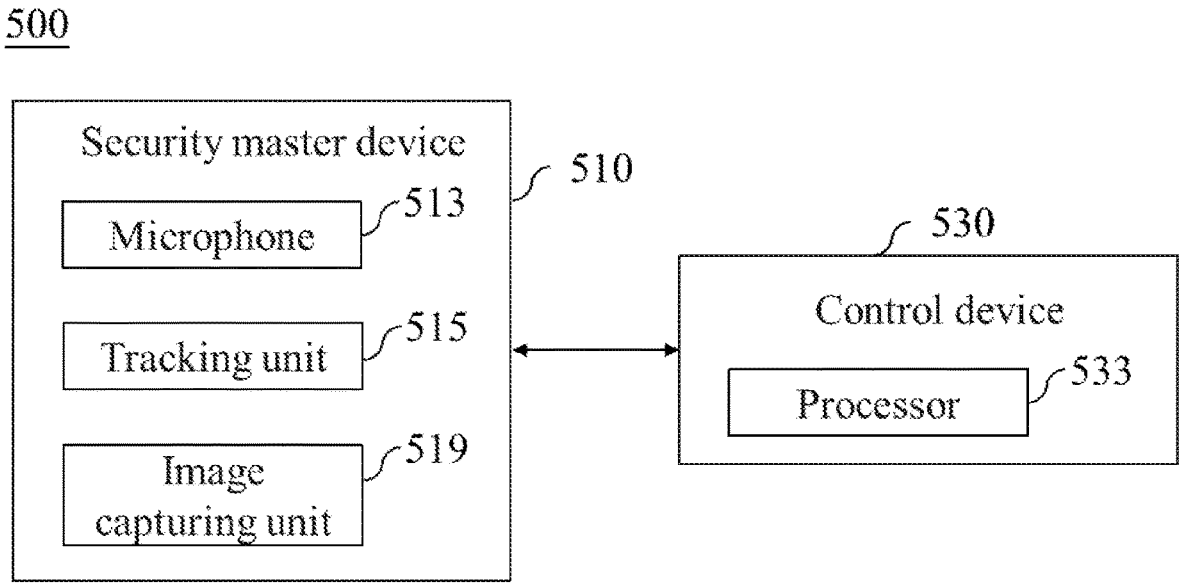
FIG. 5 is a block diagram of a security system 500 according to another embodiment of the present disclosure. The security system 500 comprises a security master device 510, and a control device 530, wherein the security master device 510 comprises a microphone 513, a tracking unit 515, and an image capturing unit 519.

Additionally or alternatively, the present security system may further comprise an image capturing unit. Reference is now made to FIG. 5, which is a block diagram of a security system 500 according to an alternative embodiment of the present disclosure. Compared with the security system 200, the security system 500 is characterized in having an image capturing unit 519 disposed in the security master device 510. The image capturing unit 519 is configured to capture an image of the intruder, and then transmit the image to the processor 533 of the control device 530. In this way, the processor 533 may determine the location of the intruder based on the acoustic and image information respectively from the microphone 513 and the image capturing unit 519, thereby controlling the release of the tracking substance from the tracking unit 515 based on the determined location. Non-limiting examples of the image capturing unit suitable for using in the present security system include, a photographic camera, a video camera (a digital or analog video camera), a camera phone, a cellular phone, a personal digital assistant (PDA), and a combination thereof.

Figure 6:
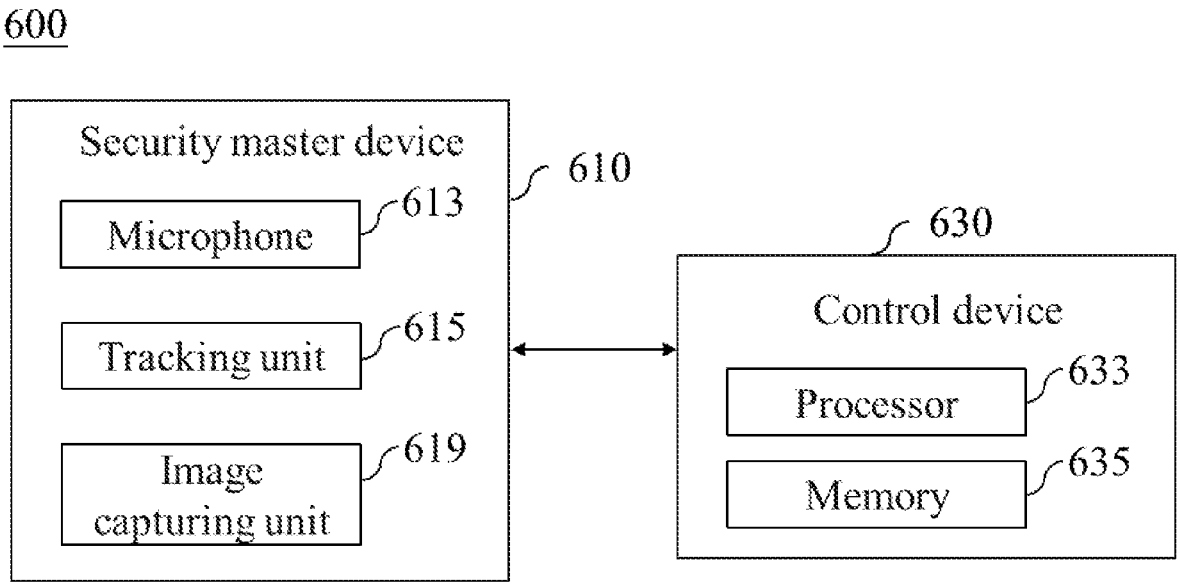
FIG. 6 is a block diagram of a security system 600 according to one embodiment of the present disclosure. The security system 600 comprises a security masters devices 610, and a processor 630, wherein the processor 630 comprises a processor 633 and a memory 635.

Optionally, the present security system further comprises a memory to store the acoustic and/or image information. Reference is now made to FIG. 6, which is a block diagram of a security system 600 according to another alternative embodiment of the present disclosure. The control device 630 of the security system 600 comprises a memory 635, which is linked to the processor 633. In this case, the acoustic event and the image respectively detected and captured by the microphone 613 and the image capturing unit 619 of the security master device 610 could be stored on the memory 635. The acoustic event and the image may thus be retrieved, copied, and/or printed from the memory 635 for further analysis. As mentioned above, the processor 633 may determine the location of the intruder based on the acoustic and image information respectively from the microphone 613 and the image capturing unit 619, thereby controlling the release of the tracking substance from the tracking unit 615 based on the determined location.

Figure 7:
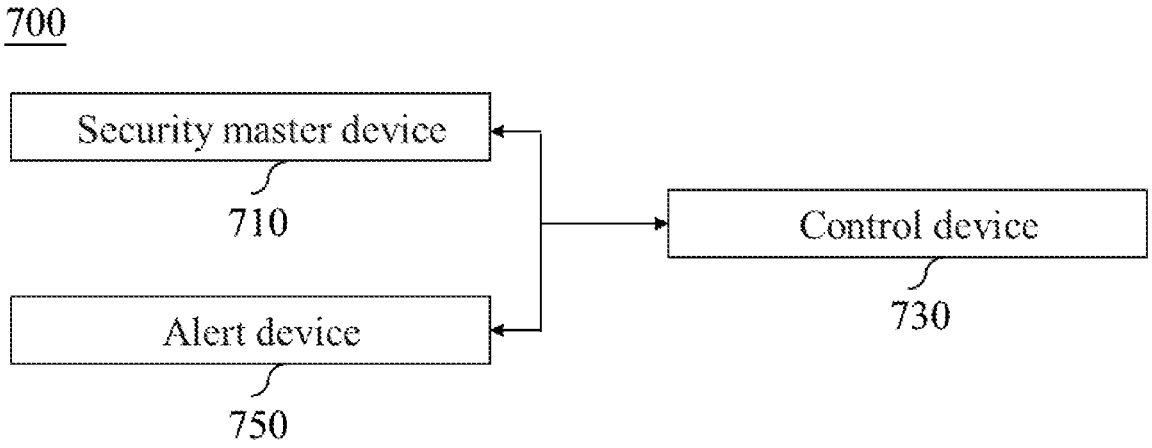
FIG. 7 is a block diagram of a security system 700 according to an alternative embodiment of the present disclosure. The security system 700 comprises a security master device 710, an alert device 750, and a control device 730 linked to the security master device 710 and alert device 750.

FIG. 7 depicts the layout of the present security system 700 in according to another embodiment of the present disclosure. In addition to the security master device 710 and the control device 730 as depicted in any of FIGS. 2 and 4-6, the present security system 700 further comprises an alert device 750 linked to the control device 730 for notifying the law enforcement officers and/or personnel (e.g., teachers and students in the school) the occurrence of the acoustic event so that he/she may promptly take a necessary action, e.g., the law enforcement officers may exert a prompt reaction against the intruder, and/or the personnel may move away and shelter himself/herself from the intruder. The alert device 750 may be a visual device, auditory device, tactile device, or a combination thereof. Further, depending on desired purposes, the alert device 550 may be a portable device, or a permanently installed device.

The communication between two devices of the present security system, e.g., between the security master device and the control device, or between the alert device and the control device, may be embodied using various techniques. For example, the system may comprise a network interface to permit communications between two devices over a network (such as a local area network (LAN), a wide area network (WAN), the Internet, or a wireless network). In another example, the system may have a system bus that couples various system components including the security master device or the alert device to the control device. In yet another embodiment, the system may have an output device for the security master device to output the data representing the acoustic event and/or image, and an input device for inputting these data into the control device.

It will be understood that the above description of embodiments is given by way of example only and that various modifications may be made by those with ordinary skill in the art. The above specification, examples and data provide a complete description of the structure and use of exemplary embodiments of the invention. Although various embodiments of the invention have been described above with a certain degree of particularity, or with reference to one or more individual embodiments, those with ordinary skill in the art could make numerous alterations to the disclosed embodiments without departing from the spirit or scope of this invention.

What is claimed is:

1. A security system for locating, tracking and deterring the movement of an intruder by detecting an acoustic event from the intruder, comprising, a plurality of security master devices, wherein each of the plurality of security master devices comprises, a microphone configured to detect the acoustic event and generate a corresponding acoustic signal, a tracking unit configured to dispense a tracking substance, and a deterrent unit configured to dispense a deterrent substance, and a control device linked to the plurality of security master devices, wherein the control device comprises a processor configured to, determine a location of the intruder via triangle localization based on the corresponding acoustic signals generated from the microphones of two neighboring security master devices, control at least one tracking unit to dispense the tracking substance based on the location of the intruder so as to track the intruder, and control at least one deterrent unit to dispense the deterrent substance based on the location of the intruder so as to deter the movement of the intruder.

2. The security system of claim 1, wherein the acoustic event is a gunshot, or an explosion.

3. The security system of claim 1, wherein the microphone is a directional microphone.

4. The security system of claim 1, wherein the tracking substance is a dye, a pigment, a fluorescent molecule, a luminescent molecule, a contrasting agent, or a combination thereof.

5. The security system of claim 1, wherein the deterrent substance is a net, a tear gas, a pepper spray, a rubber bullet, or a combination thereof.

6. The security system of claim 1, wherein each of the plurality of security master devices further comprises an image capturing unit that is configured to capture an image of the intruder and transmits the image to the processor.

7. The security system of claim 6, wherein the control device further comprises a memory that is linked to the processor and configured to store the acoustic event or the image.

8. The security system of claim 1, further comprising an alert device linked to the control device.

9. The security system of claim 1, wherein each security master device is spaced at least 5 meters from its adjacent security master device.

10. The security system of claim 9, wherein each security master device is spaced about 5-10 meters from its adjacent security master device.

11. The security system of claim 1, wherein the processor is further configured to direct the security master devices toward the location of the intruder based on the detected acoustic event.

12. A method of locating, tracking and deterring the movement of an intruder via detecting an acoustic event from the intruder by using the security system of claim 1, comprising, detecting the acoustic event by the microphones;

determining a location of the intruder by the processor based on the detected acoustic event;

dispensing the tracking substance from one or more of the tracking units based on the determined location of the intruder so as to track the intruder; and dispensing the deterrent substance from one or more of the deterrent units based on the determined location of the intruder so as to deter the movement of the intruder.

13. The method of claim 12, wherein the acoustic event is a gunshot, or an explosion.

14. The method of claim 12, wherein each of the microphones is a directional microphone.

15. The method of claim 12, wherein the tracking substance is a dye, a pigment, a fluorescent molecule, a luminescent molecule, a contrasting agent, or a combination thereof.

16. The method of claim 12, wherein the deterrent substance is a net, a tear gas, a pepper spray, a rubber bullet, or a combination thereof.

* * * * *